US006154910A

United States Patent [19]

Corney

[11] Patent Number: 6,154,910

[45] Date of Patent: Dec. 5, 2000

[54] BRIDGE STABILIZATION

[75] Inventor: John Michael Corney, Bredhurst, United Kingdom

[73] Assignee: GEC-Marconi Limited, Middlesex, United Kingdom

[21] Appl. No.: 09/194,408

[22] PCT Filed: May 27, 1997

[86] PCT No.: PCT/GB97/01435

§ 371 Date: Aug. 23, 1999

§ 102(e) Date: Aug. 23, 1999

[87] PCT Pub. No.: WO97/45593

PCT Pub. Date: Dec. 4, 1997

[30] Foreign Application Priority Data

May 29, 1996 [GB] United Kingdom ..... 9611149

[51] Int. Cl.[7] ..... E01D 11/00

[52] U.S. Cl. ..... 14/18; 14/22

[58] Field of Search ..... 14/18, 19, 20, 14/22

[56] References Cited

U.S. PATENT DOCUMENTS 4,741,063 5/1988 Diana ..... 14/18

FOREIGN PATENT DOCUMENTS

| | | |
|---|---|---|
| 0233528 | 8/1987 | European Pat. Off. . |
| WO93/16232 | 8/1993 | WIPO . |
| WO94/05862 | 3/1994 | WIPO . |
| WO94/10386 | 5/1994 | WIPO . |
| WO94/10387 | 5/1994 | WIPO . |

*Primary Examiner*—James A. Lisehora

*Attorney, Agent, or Firm*—Venable; Robert J. Frank; Robert Kinberg

[57] ABSTRACT

A bridge deck (10) is supported by tensile supports (11 and 12) and stabilized to reduce the overall aerodynamic lift on the deck (10) by the addition of aerofoil stabilizers (19 and 20) pivotally secured about respective axes (21) generally longitudinal of the deck (10). The stabilizers (19 and 20) are driven by a mechanism (21 to 26) operable by angular movement between the deck (10) and the tensile supports (11 and 12) to articulate the stabilizers (19 and 20) to a position which will generate a force, in the presence of a cross wind, to reduce the overall aerodynamic lift on the deck (10).

12 Claims, 3 Drawing Sheets

BRIDGE STABILIZATION

TECHNICAL FIELD

This invention is concerned with the stabilisation of bridges comprising a deck supported by tensile supports and provides both a stabilised bridge structure and a method of stabilising an existing bridge.

BACKGROUND ART

Various types of bridge have a deck supported by tensile supports from towers, or similar structures, erected at, or intermediate, the ends of the bridge. In the case of a suspension bridge the tensile supports are typically vertical cables, rods or chains interconnecting each longitudinal side of the deck to a corresponding catenary suspended between the towers. A cable-stayed bridge also comprises a deck supported by tensile supports, usually in the form of rods or cables, extending from the longitudinal sides of the deck directly to the towers.

It is well known from the Tacoma bridge disaster in 1940 that a suspension bridge can suffer dramatic structural failure due to fluttering instability in a sustained modest wind loading which caused a resonant oscillation of the deck which built up progressively until destruction occurred. The problems associated with wind loading of suspension bridges, and indeed all bridges comprising a deck supported by tensile supports, become much more severe as the span of the deck increases. With a very long span, for instance that proposed for the Straights of the Messina, the wind loading along the span can vary substantially and can promote substantial asymmetric pitching and heaving of the deck. Since the Tacoma bridge disaster, various proposals have been made to address this problem. For instance, in European Patent 0233528, it has been proposed that a suspension bridge, comprising a suspension structure formed of cantenary wires and vertical stays and a substantially rigid planar deck structure hung onto the suspension structure, could be stabilised by aerodynamic elements which are shaped like aerofoils and are rigidly fixed to the bridge structure to control the action of the wind on the structure, the aerodynamic elements consisting of wing control surfaces which have a symmetrical profile and an aerodynamic positive or negative lifting reaction together with a flutter speed considerably higher than the flutter speed proper to the bridge structure, the wing surfaces being fixed just under the lateral edges of the deck structure of the bridge, with their plane of symmetry inclined in respect of the horizontal plane, the bridge structure and the wing control surfaces interacting dynamically in order to shift the flutter speed of the whole at least above the top speed of the wind expected in the bridge area.

Instead of using aerofoils rigidly fixed to the bridge structure, International Patent Application PCT/GB93/01862 (Publication Number WO 94/05862) teaches that a bridge deck can be made less stiff than the decks of existing bridges by using flaps, or ailerons, provided at the lateral edges of the bridge deck, the flaps or ailerons being pivoted from the bridge deck for articulation between extended and retracted positions, and being computer controlled to regulate the forces on the deck in response to wind loading.

International Patent Application PCT/DK-93/00058 (Publication Number WO 93/16232) teaches a system for counteracting wind induced oscillations in the bridge girder on long cable supported bridges, wherein a plurality of control faces are arranged substantially symmetrically about the longitudinal axis of the bridge and are adapted to utilise the energy of the wind in response to the movement of the bridge girder for reducing said movement, the control faces being divided into sections in the longitudinal direction of the bridge, and a plurality of detectors are provided for measuring the movements of the bridge girder, and a local control unit is associated with each control face section and is adapted to control the control face section in question in response to information from one or more of the detectors. These detectors are arranged to measure the movements or accelerations of the bridge at the point concerned and to transmit a signal to a control unit, such as a computer, which uses an algorithm to apply a signal to a servo pump controlling a hydraulic cylinder to rotate the associated control face section. In this manner, each control face section can be adjusted continuously in response to the movements of the bridge girder at the point in question as measured by the detectors which are in the form of accelerometers. This invention essentially requires the provision of a complex electronic system incorporating a significant number of accelerometers connected by extensive wiring along the bridge girder to the computers, and an associated hydraulic system for driving the control faces.

From WO 93/16232 and these prior art documents it is known for a bridge to comprise a deck supported by tensile supports, and aerofoil stabilisers pivoted about respective axes generally longitudinal of the deck for articulation to a position to improve stability of the deck.

It is also known from these documents to provide a method of stabilising a bridge having a deck supported by tensile supports including mounting aerofoil stabilisers about respective axes generally longitudinal of the deck.

DISCLOSURE OF INVENTION

It is an object of the present invention to enable a bridge to be stabilised without the use of an extensive electronic sensing and control system.

According to one aspect of the invention each stabiliser is mechanically connected to the deck and an adjacent tensile support through a mechanism operable by angular movement between the deck and tensile support about a longitudinal axis of the bridge such that, when there is angular movement between a portion of the deck and the adjacent tensile support, the associated stabiliser will be articulated by that movement through the mechanism to a position which will generate a force on its deck portion, in the presence of a cross wind. In this manner it is possible to stabilise a bridge by minimising the coupling between rotational and vertical movements of the deck, thereby damping any tendency of the structure to flutter.

Preferably each mechanism includes a lever which is secured to the associated tensile support and is pivoted to the deck about an axis generally parallel to the pivot axis of the associated stabiliser. Each mechanism may be arranged to amplify the articulation of its associated stabiliser with respect to the angular movement.

At least some of the stabilisers may be pivoted about their respective axes directly to the deck and be arranged to be articulated by respective links pivoted to their respective levers.

At least some of the stabilisers may be pivoted about their respective axes directly to the deck and be positioned to modify the aerodynamic properties of the deck. Alternatively at least some of the stabilisers may be pivoted above their respective axes either from the tensile supports or from their respective levers. In this case each stabiliser is preferably arranged to be articulated by a link pivoted to the deck.

At least one of the stabilisers may be provided with an independently adjustable control surface. In this manner the control surface can be adjusted relative to the stabiliser thereby altering the force that will be generated by the stabiliser and applied to the deck.

Preferably the stabilisers are arranged in pairs which are mounted on opposite sides of the deck and are counterbalanced by an interconnecting link. In this case the interconnecting link is preferably arranged operatively between the mechanisms of the pair of stabilisers.

According to another aspect of the invention a method includes mechanically connecting the deck and adjacent tensile support using a mechanism operably by angular movement between the deck and the tensile supports about a longitudinal axis of the bridge such as to articulate the stabilisers by movement through the mechanism to a position which will generate a force, in the presence of a cross wind, to reduce the overall aerodynamic lift on the deck.

BRIEF DESCRIPTION OF DRAWINGS

The invention will now be described, by way of example only, with reference to the accompanying drawings, in which.

DESCRIPTION

It is well known that long span suspension bridges have a tendency to suffer from flutter-like instability during conditions of very high winds. One approach to this problem has been to increase the torsional stiffness of the bridge deck, thereby increasing the wind speed at which instability occurs. This is achieved by conventional structural techniques which inevitably increase the weight of the bridge deck and consequently also increase the weight of the suspension cables and their supporting structure. An alternative approach has been to augment stability of the bridge deck by means of actively controlled aerofoils. Such active stabilisation closely follows practice already adopted in aircraft control systems, where aerofoils, or other control services, are appropriately deflected by means of hydraulic, pneumatic or electrical actuators in response to the sensed motion of the vehicle, which in this case is the local part of the flexible bridge deck structure being stabilised.

The present invention provides an alternative approach to active stabilisation by controlling aerofoils mechanically by means of linkages connected to the bridge deck suspension members. In this manner stabilisation can be achieved without the use of a plurality of accelerometers and the associated wiring, computer control and service systems which have been proposed for articulating aerofoils by means of hydraulic, pneumatic or electrical actuators.

Figure 1:
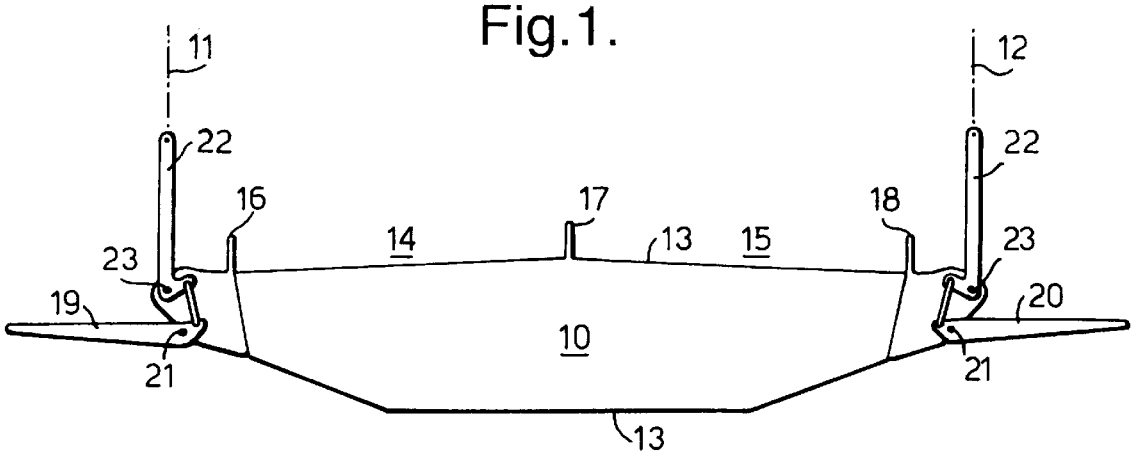
FIG. 1 is a diagrammatic transverse section through the deck of a bridge stabilised in accordance with the present invention.
Figure 2:
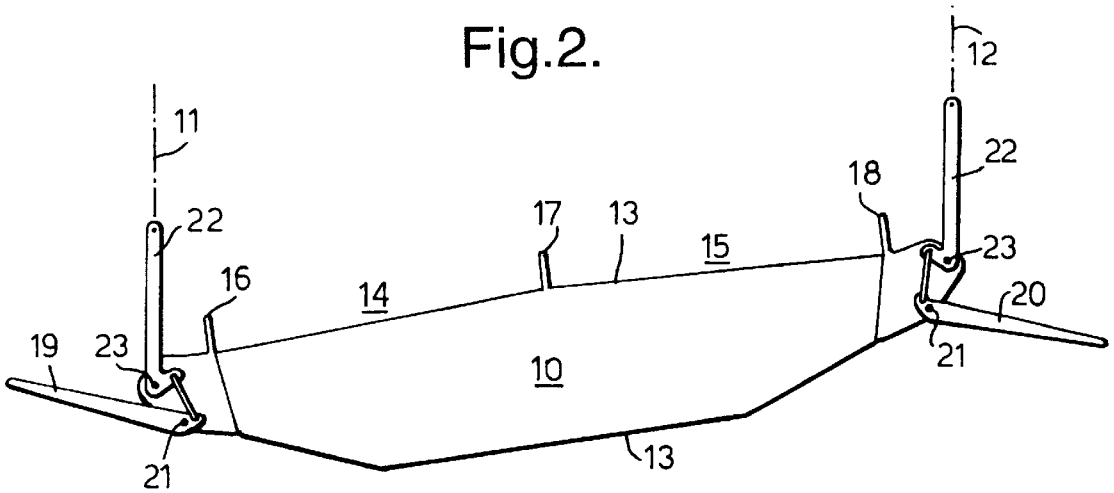
FIG. 2 is a view similar to FIG. 1 but illustrating the movement of a pair of stabilisers during angular movement in one direction between the deck and an adjacent tensile support about a longitudinal axis of the bridge.
Figure 3:
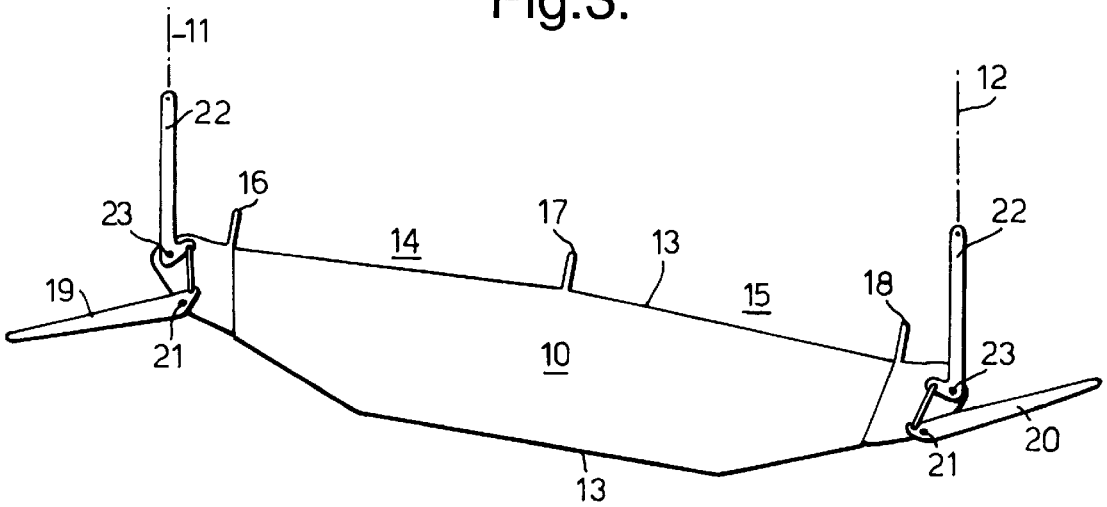
FIG. 3 is a view similar to FIG. 2 but illustrating the movement of the stabilisers during angular movement in the opposite direction between the deck and an adjacent tensile support.

With reference to FIGS. 1, 2 and 3, a suspension bridge comprises a deck 10 supported from a pair of unshown catenaries by two series of tensile supports 11 and 12 which are conveniently formed as rods or cables. The bridge deck can be of any convenient construction known in the an and typically comprises a box girder 13 defining carriageways 14, 15 separated by raised curbs 16, 17 and 18. Irrespective of its specific cross sectional profile, the deck 10 has aerodynamic properties when exposed to a cross wind and its stability is controlled by two series of aerofoil stabilisers 19 and 20 positioned along each longitudinal edge of the deck 10. Each stabiliser is connected to the deck 10 by a pivot 21 for articulation about an axis which is generally longitudinal of the deck, thereby allowing articulation of the stabiliser 19, 20 to a position which will generate a force, in the presence of cross wind, to reduce the overall aerodynamic lift on the associated portion of the deck 10.

The lower ends of the tensile supports 11, 12 are very firmly attached to the ends of levers 22 which are also secured to the deck 10 by respective pivots 23, thereby permitting angular movement between each tensile support 11 or 12 and the deck 10 about the axes of the pivots 23 which are generally parallel to the axis 21 of the associated stabiliser.

Figure 4:
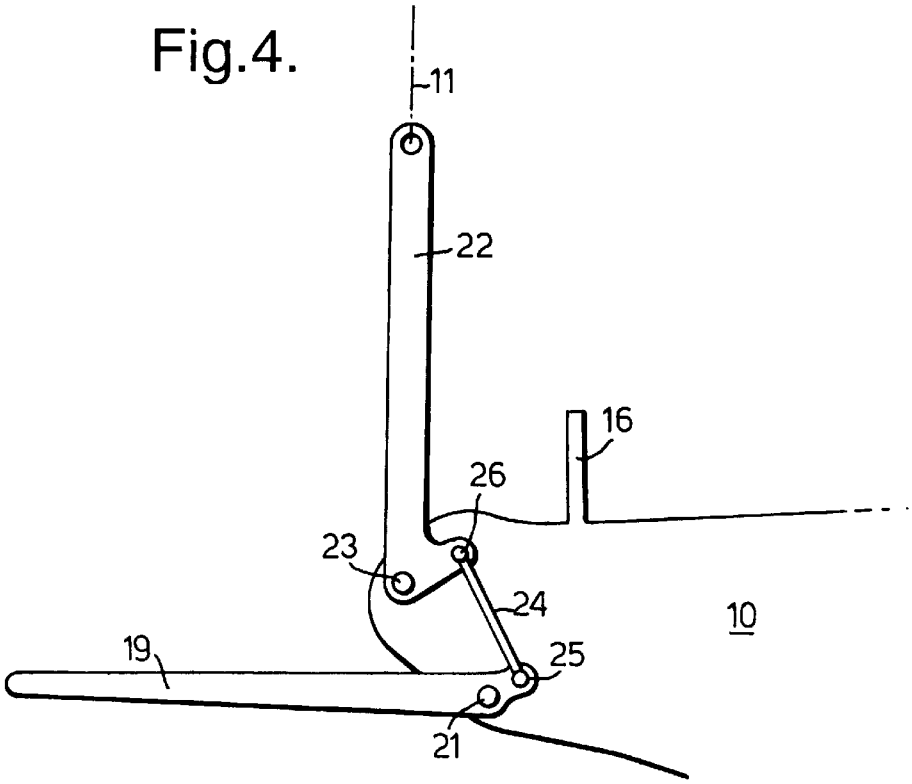
FIG. 4 is an enlargement of the left-hand portion of FIG. 2 illustrating one form of mechanism operable by angular movement between the deck and the adjacent tensile support.

As will best be seen from FIG. 4, a link 24 is connected by a pivot 25 to the stabiliser 19 at a point spaced from the pivot 21, and also by a pivot 26 to the lever 22 at a point spaced from the pivot 23, the pivots 21, 23, 25 and 26 being parallel. In this manner, any angular movement between the deck 10 and the tensile support 11 will cause relative angular movement of the lever 22 about its pivot 23, thereby causing the link 24 to transmit this motion to the stabiliser 19 which will rotate in the same direction about it pivot 21. It will be noted that the effective lever arm bet ween the pivots 23 and 26 is greater than that between the pivots 21 and 25 whereby the relative angular movement of the lever 22 causes an amplified movement of the stabiliser 19. It will also be noted that the lever 22 and the link 24, together with their associated pivots 21, 23, 25 and 26 form a mechanism operable by angular movement between the deck 10 and the adjacent tensile support 11.

In this manner any torsional movement of the bridge deck 10 relative to any of the tensile supports 11 or 12 will cause articulation of the adjacent stabiliser 19 or 20, thereby modifying the aerodynamic properties of the deck 10. Thus, in FIG. 2, counterclockwise rotation of a portion of the deck 10 simultaneously causes the left hand stabiliser 19 to be lifted whilst the right hand stabiliser 20 is lowered. In this manner the stabilisers 19 and 20 will exert a restoring couple to the deck 10 irrespective of whether the cross wind is from the left or from the right.

In FIG. 3 the deck 10 has been rotated clockwise and it will be noted that the movement of the stabilisers 19 and 20 are similarly reversed so that they will again exert a restoring couple on the deck 10.

It should be particularly noted that the deflection of the stabilisers 19 and 20 will always augment the stability of the deck 10, regardless of whether the wind is blowing from the left or the right.

The ratio of the distances between the pivots 23 and 26 and the pivots 21 and 25 will depend on the dynamics of the deck 10 and its suspension 11, 12 and can be determined by wind tunnel tests and/or theorical calculations. The ratio will, for some bridge constructions, depend upon the spanwise position of the particular stabiliser 19 or 20.

Figure 5:
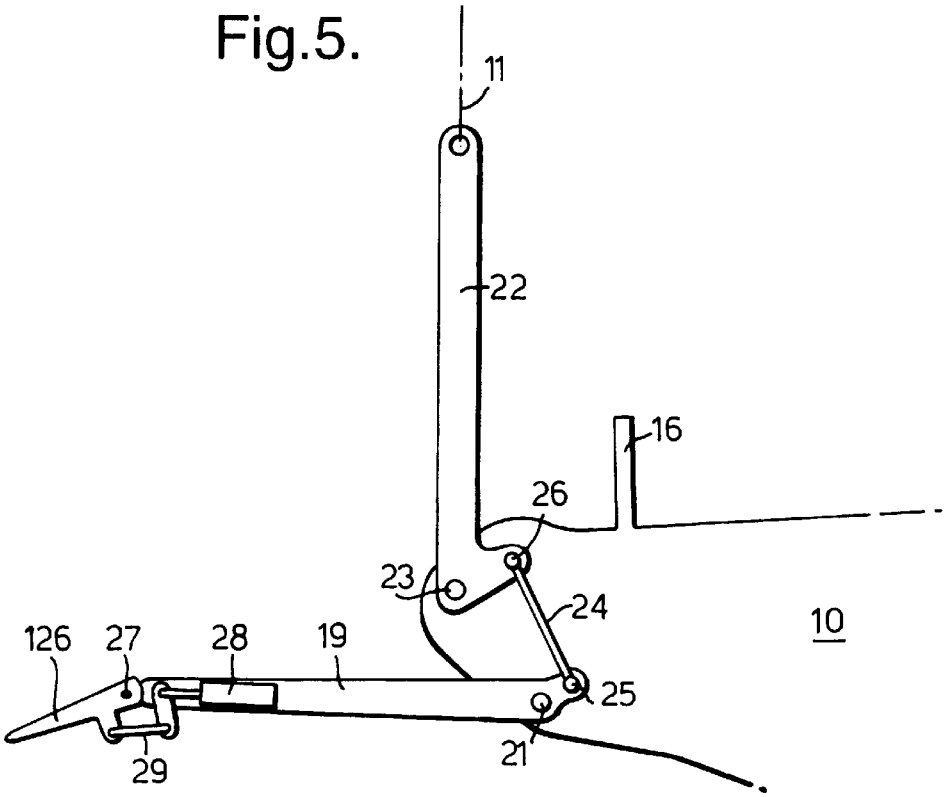
FIG. 5 is a view similar to FIG. 4 but showing a modification to the aerofoil stabilisers.

In FIG. 5, most of the components are equivalent to those in FIG. 4 and have been identified with the same reference numerals as they have the same function. The only modification is that the outer end of the stabiliser 19 is provided with an independently adjustable control surface 126 which is connected to the stabiliser 19 by a pivot 27 which is parallel to the axis of pivot 21. The control surface 126 can be articulated, about its pivot 27, relative to the stabiliser 19, by a power actuator 28 which is housed within the stabiliser 19 as shown and drives the control surface 126 through a linkage 29. The power actuator can be operated mechanically in order to set the control surface 126 in a position to give the stabiliser 19 a desired characteristic for the portion of the deck to which it is attached, or can be operated electrically, pneumatically or hydraulically whereby the characteristics of the stabiliser 19 may be continuously adjusted.

The benefit of a mechanically linked stabiliser arrangement, such as that described with reference to FIGS. 1 to 4, is the absence of any large power actuators which would obviously need a continuous available source of energy, even in the midst of hurricane force winds, and the absence of computers and accelerometers. However, an active control approach, in common with comparable aircraft systems, is extremely flexible as changes to the control system can be accommodated with relative ease, and functional complexity can be provided as necessary.

The attraction of the combined implementation taught by FIG. 5 is that the best features of both approaches can be included. In this manner, the benefit of large mechanically-driven stabilisers 19, 20 can be achieved and their function can be augmented by small actively controlled surfaces 126 in a similar manner to a trim tab on an aircraft elevator.

In this manner the bulk of the stabilisation will be performed by the large mechanically operated stabilisers 19 and 20, whilst the small actively controlled surfaces 126 would finely tune performance whilst being undemanding in terms of size, cost, power requirement and integrity, when compared with a stand-alone active control system.

Figure 6:
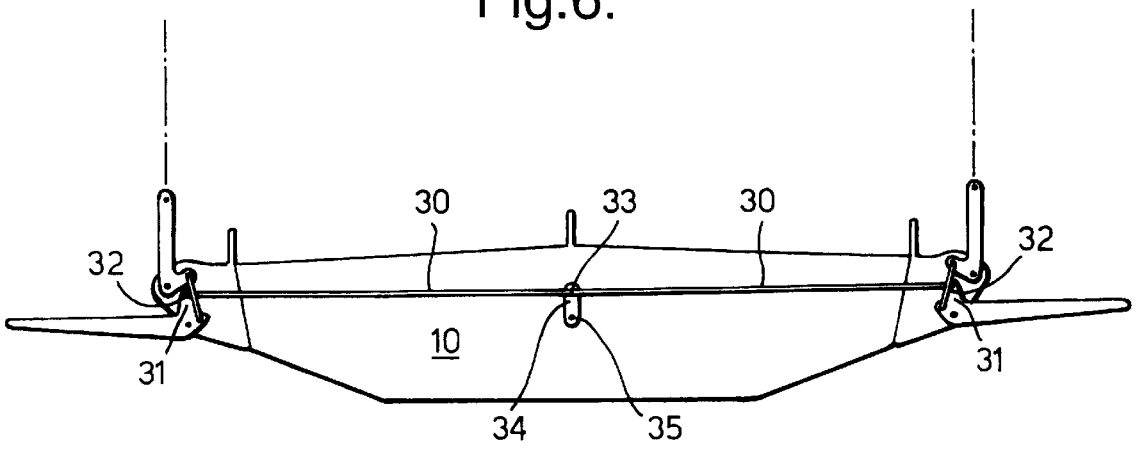
FIG. 6 is a view similar to FIG. 1 but illustrating the counterbalancing of a pair of stabilisers.

FIG. 6 shows a construction which is generally the same as that already described with reference to FIGS. 1 to 4, and accordingly the same reference numerals have been used to denote the equivalent components. The difference is that the masses of the stabilisers 19 and 20 are balanced by interconnecting links 30 which have their outer ends connected to extensions 31 of the stabiliser mounting by respective pivots 32 of which the axes are parallel with the pivots 21 and 23. The inner ends of the links 30 are joined by a common pivot 33 to a link 34 which is allowed to rotate about a pivot 35 carried by the bridge deck 10. In this manner, the masses of a transversely aligned pair of stabilisers 19 and 20 are counter-balanced irrespective of their articulation.

Figure 7:
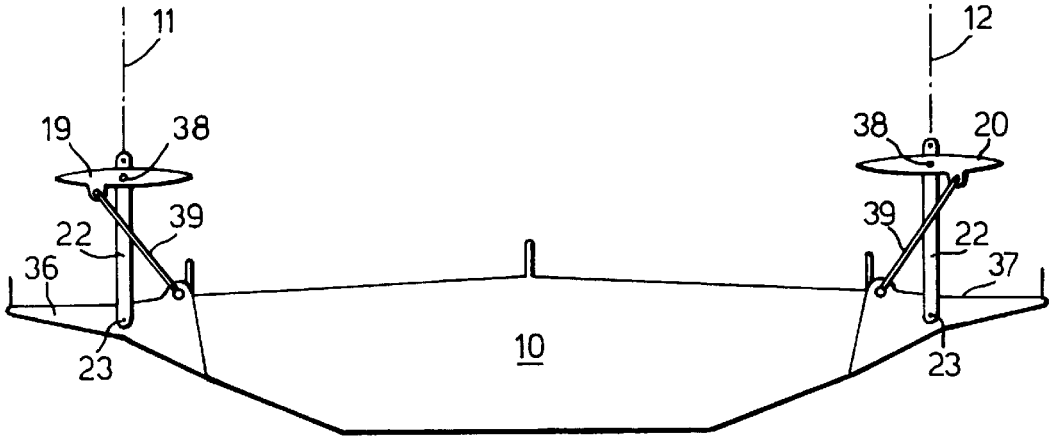
FIG. 7 is a view similar to FIG. 1 but illustrating an alternative mounting for the stabilisers on a different bridge deck.

In FIG. 7 the bridge deck 10 is of somewhat different construction insofar as the levers 22 are mounted on pivots 23 positioned inboard of the outer longitudinal edges of the deck 10, thereby defining walkways 36 and 37. The aerofoil stabilisers 19 and 20 have also been moved so that they are now connected for articulation about pivots 38 which extend longitudinally of the deck 10 and are carried by the respective levers 22. The stabilisers 19 and 20 are articulated by respective links 39 which are pivoted as shown between the deck 10 and the stabilisers 19 and 20. It will be noted that the links 39 cross the levers 22 to ensure that the angular movement between the deck 10 and the adjacent tensile supports 11 and 12 will cause the stabilisers 19 and 20 to be articulated in the appropriate direction. With this arrangement it will be appreciated that, rather than modifying the aerodynamic properties of the deck 10, the stabilisers 19 and 20 exert compensating forces to the deck 10 via their respective levers 22. If desired, the stabilisers 19 and 20 may alternatively be mounted directly on the tensile supports 11 and 12.

In the case where the tensile supports are formed by suspension rods, the rods themselves would be connected to an appropriate trunnion which would receive the pivots 23, whereby the tensile support bar 11 or 12 would replace the upper arm of the lever 22, the trunion being designed to provide the mounting for the pivot 26.

The mechanisms taught by FIGS. 4 and 7 may be replaced by any other convenient mechanism or gearing which will drive the stabilisers 19 and 20 as required.

If desired, a bridge deck 10 can be fitted with the stabilisers 19 and 20 of both FIGS. 4 and 7.

In addition to providing a bridge structure having a novel form of stabilisation, it will be noted that the arrangements taught herein can be used to modify existing bridges having a deck supported by tensile supports and that this can be achieved without the need for completely dismantling the bridge.

What is claimed is:

1. A bridge comprising a deck (10) supported by tensile supports (11, 12), and aerofoil stabilisers (19, 20) pivoted about respective axes (21, 38) generally longitudinal of the deck (10) for articulation to a position to improve stability of the deck (10), characterised in that each stabiliser (19, 20) is mechanically connected to the deck (10) and an adjacent tensile support (11, 12) through a mechanism operably by angular movement between the deck (10) and tensile support (11, 12) about a longitudinal axis of the bridge such that, when there is angular movement between a portion of the deck (10) and the adjacent tensile support (11, 12), the associated stabiliser (19, 20) will be articulated by that movement through the mechanism to a position which will generate a force on its deck portion (10), in the presence of a cross wind.

2. A bridge, as in claim 1, characterised in that each mechanism includes a lever (22) which is secured to the associated tensile support (11, 12) and is pivoted to the deck (10) about an axis (23) generally parallel to the pivot axis (21, 38) of the associated stabiliser (19, 20).

3. A bridge as in claim 2, characterised in that at least some of the stabilisers (19, 20) are pivoted about their respective axes (21) directly to the deck (10) and are arranged to be articulated by respective links (24) pivoted (25, 26) to their respective levers (22).

4. A bridge, as in claim 2, characterised in that at least some of the stabilisers (19, 20) are pivoted about their respective axes (38) from their respective levers (22).

5. A bridge, as in claim 4, characterised in that each stabiliser (19, 20) is arranged to be articulated by a link (39) pivoted to the deck (10).

6. A bridge, as in claim 1, characterised in that each mechanism is arranged to amplify the articulation of its associated stabiliser (19, 20) with respect to the angular movement.

7. A bridge, as in claim 1, characterised in that at least some of the stabilisers (19, 20) are pivoted about their respective axes (21) directly to the deck (10) and are positioned to modify the aerodynamic properties of the deck (10).

8. A bridge, as in claim 1, characterised in that at least some of the stabilisers (19, 20) are pivoted about their respective axes (38) from the tensile supports (11, 12).

9. A bridge, as in claim 1, characterised in that at least one of the stabilisers (19, 20) is provided with an independently adjustable control surface (126).

10. A bridge, as in claim 1, characterised in that a pair of the stabilisers (19, 20) are mounted on opposite sides of the deck (10) and are counter-balanced by an interconnecting link (30, 34).

11. A bridge, as in claim 10, characterised in that the interconnecting link (30, 34) is operatively arranged between the mechanisms of the pair of stabilisers (19, 20).

12. A method of stabilising a bridge having a deck (10) supported by tensile supports (11, 12), and having aerofoil stabilisers (19, 20) mounted about respective axes (21, 38) generally longitudinal of the deck (10) characterised by mechanically connecting the deck (10) and adjacent tensile support (11, 12) using a mechanism operable by angular movement between the deck (10) and the tensile supports (11, 12) about a longitudinal axis of the bridge such as to articulate the stabilisers (19, 20) by movement through the mechanism to a position which will generate a force, in the presence of a cross wind, to reduce the overall aerodynamic lift on the deck (10).

* * * * *